United States Patent [19]

Krasuk et al.

[11] Patent Number: 4,572,781

[45] Date of Patent: Feb. 25, 1986

[54] SOLVENT DEASPHALTING IN SOLID PHASE

[75] Inventors: Julio Krasuk; Rodolfo B. Solari; Luis G. Aquino; Jose V. Rodriguez; Alejandro Granados, all of Caracas, Venezuela

[73] Assignee: Intevep S.A., Caracas, Venezuela

[21] Appl. No.: 584,955

[22] Filed: Feb. 29, 1984

[51] Int. Cl.[4] ..... C10C 3/00; C10C 3/08

[52] U.S. Cl. ..... 208/309; 208/45

[58] Field of Search ..... 208/45, 309

[56] References Cited

U.S. PATENT DOCUMENTS

| | | | |
|---|---|---|---|
| 2,669,538 | 2/1954 | Yurasko et al. | 208/309 |
| 3,159,571 | 12/1964 | Reman et al. | 208/39 |
| 3,278,415 | 10/1966 | Doberen et al. | 208/309 |
| 3,334,043 | 8/1967 | Ferris et al. | 208/309 |
| 3,364,138 | 1/1968 | Campagne et al. | 208/309 |
| 3,830,732 | 8/1974 | Gatses | 208/309 |
| 4,021,335 | 5/1977 | Beaton | 208/309 |
| 4,101,415 | 7/1978 | Crowley | 208/309 |
| 4,211,633 | 7/1980 | Gleim | 208/309 |
| 4,239,616 | 12/1980 | Gearhart | 208/309 |
| 4,395,330 | 7/1983 | Auboir et al. | 208/309 |
| 4,421,639 | 12/1983 | Lambert et al. | 208/309 |

FOREIGN PATENT DOCUMENTS

| | | | |
|---|---|---|---|
| 1715543 | 8/1965 | Canada | 208/45 |
| 1842768 | 5/1970 | Canada | 208/45 |
| 36-15386 | 11/1961 | Japan | 208/309 |
| 1994289 | 6/1965 | United Kingdom | 208/45 |
| 1340022 | 12/1973 | United Kingdom | 208/309 |
| 2031011 | 4/1980 | United Kingdom | 208/309 |

OTHER PUBLICATIONS

Chemical Engineering Progress, Apr. 1978, p. 75 "Influence of Solvent Properties on Dryer Design" Cook, et al.

*Primary Examiner*—John Doll
*Assistant Examiner*—Helane Myers
*Attorney, Agent, or Firm*—Sughrue, Mion, Zinn, Macpeak & Seas

[57] ABSTRACT

A process for separating substantially dry asphaltenes of high softening point from heavy hydrocarbon material comprising:

(a) admixing heavy hydrocarbon material containing asphaltenes with a solution of deasphalted oil and an aliphatic hydrocarbon precipitant in a first mixing zone to form a mixture and precipitate asphaltenes;

(b) in a first separation zone the mixture from step (a) into (i) a first solution of deasphalted oil and precipitant and (ii) a slurry of solid asphaltene particles in a solution of precipitant and desasphalted oil;

(c) separating the first solution of step (b) to obtain said precipitant and the deasphalted oil almost free of asphaltenes;

(d) introducing the slurry of asphaltenes of step (b) into a second mixing zone and washing the slurry with a volume of fresh precipitant to remove deasphalted oil;

(e) introducing the mixture from the second mixing zone into a second separation zone that comprises a centrifugal decanter to separate a liquid phase from a highly concentrated slurry of solid asphaltenes;

(f) recycling the liquid phase from the second separation zone to said first mixing zone;

(g) introducing the concentrated slurry of solid asphaltenes from the second separation zone into a solvent removal system to recover the solvent and to obtain a product comprising fine particles of high softening point asphaltenes; and (h) recycling the solvent recovered in the solvent removal system to the second mixing zone.

13 Claims, 2 Drawing Figures

SOLVENT DEASPHALTING IN SOLID PHASE

BACKGROUND OF THE INVENTION

1. Field of the Invention

The present invention relates to a process for the removal of asphaltenes of high molecular weight and high softening point from heavy hydrocarbon materials, by using a precipitant to precipitate these asphaltenes and separate them in a solid form.

2. Description of the Prior Art

Heavy crude oils have high asphaltene content which is detrimental to further processing of these crude oils to convert them into more valuable products. This is due to the high metal concentration in the asphaltenes. For example, in catalytic desulfurization, these metals deposit on the catalyst surfaces poisoning the catalyst, and increase significantly the desulfurization cost.

In distilling these heavy oils, it is only possible to recover about 40 to 60 weight percent of distillates and heavy gas oil, still leaving a large fraction of heavy residue with high concentrations of asphaltenes, metals and sulfur. By means of solvent deasphalting using a precipitant of high molecular weight, it is possible to make a deep cut and extract more oil and resins, thus increasing the recovery of oil products almost free of asphaltenes and having a lower metal content, which can be used as a feed to downstream refining processes, such as fluid catalytic cracking, catalytic desulfurization or the like. The metals are mainly concentrated in the precipitated asphaltenes of high softening point, which are discarded.

Paraffinic solvents have been used for many years to deasphalt heavy hydrocarbons. The development of the propane and butane deasphalting processes was a very important contribution to petroleum technology in the refining of residual oils and provided a method for a substantially complete separation of oil from the asphaltic material contained in the residual derived from any crude source. These processes usually operate near the critical temperature of the paraffinic solvent and above the liquefaction temperature of the asphaltenes, and the deasphalting step is performed in a countercurrent solvent extraction tower like the one described in U.S. Pat. No. 3,811,843.

In recent years, solvent deasphalting has evolved in the direction of increasing deasphalted oil yields, using heavier paraffinic solvents, like butane/pentane mixtures or pentanes alone. The process operates with two or more extraction stages, and the heavy materials removed in the process include both resins and asphalt. This procedure is described in U.S. Pat. No. 4,239,616, where asphaltenes, resins and oil are separated in three stages operating at temperatures and pressures above the critical conditions of the solvent used. In this manner, energy is saved since solvent recovery from the oil is effected by the difference in density between the oily phase and the gas dense solvent phase, avoiding evaporation of the solvent from the oil.

A characteristic common to all these deasphalting processes is that the asphaltic materials are obtained in liquid phase after the solvent is recovered by stripping with steam or an inert gas, at varying temperatures depending on the asphalt softening point. Usually, these processes have some limitations if higher molecular weight solvents, like pentane, hexane, heptane or light naphthas are used to give a high yield of oil, since these hydrocarbons selectively precipitate an almost oil-free asphaltenic material of very high softening point. It is well accepted that processing asphaltic material having a softening point higher than 200° C. leads to almost insurmountable difficulties. For example, G.B. Pat. No. 2,031,011A, indicates that in a pentane deasphalting operation, where operating conditions were set to obtain a high yield of deasphalted oil, the resultant asphaltic material, with a softening point of 186° C., caused a blocking phenomenon in the pipes of the apparatus because its viscosity was too high, even at 186° C., rendering the operation impossible. Accordingly, the conclusion was that obtaining high yields of deasphalted oils by such processes is not industrially viable unless a fluxant oil is added to lower the viscosity.

These difficulties in operation with solvents heavier than propane and butane arise from the fact that the precipitated asphaltic material is not oily, but consists of very fine solid asphaltene particles which can easily plug or stick to either the extractor walls or the stripping column. It is well documented in the literature (E. W. Funk, *Canadian Journal of Chemical Engineering*, Vol. 57, p. 333 (June 1979)), that at room temperature, the particle size of the precipitated asphaltenes can be less than 1–2 microns, and the particle size distribution largely depends on the solvent molecular weight. The pentane asphaltenes are of larger particle size than the hexane asphaltenes and this trend continues through octane, etc. The molecular weight of these asphaltenes also varies, and it has been reported to be in the range of 2000 up to 100,000. At the same time, the softening point is from 170° C. for pentane asphaltenes to over 280° C. for asphaltenes precipitated with naphthas.

To overcome some of these operating difficulties, particular methods have been proposed to separate the fine solid particles of asphaltenes using a centrifugal force field. U.S. Pat. No. 3,159,571 describes a process to separate the asphaltenes and ash-forming constituents from an oil mixture by forcing the solvent-oil mixture through one or more hydrocyclones. The oil mixture is previously heated to promote agglomeration of precipitated particles. Temperatures of 35°–65° C. are applied both for agglomeration and during hydrocyclone separation. Precipitation can also be supplemented by aliphatic polar compounds including alcohols, ethers and ketones.

French Pat. No. 1,576,871 and equivalent G.B. Pat. No. 1,175,028 describe an improved process to separate asphaltenes using one or more hydrocyclones. Asphaltenes are precipitated at a temperature which is 5° to 15° C. below the softening point of the asphaltenes. The process has two separation stages in series to separate oil, resins and asphaltenes. Asphaltenes are separated in two hydrocyclones. The first one separates the oil-free asphaltenes, and in the second the asphaltenes are washed with fresh solvent. The oil is separated from the resins by means of a settling tank, at a temperature 10° to 50° C. below the critical temperature of the mixture. In these patents it is assumed that in the washing step performed in the second cyclone there is a complete separation of the solvent and the solid asphaltenes, and that solvent-free asphaltenes are obtained at the bottom outlet of the second cyclone.

It is well known, however, that hydrocyclones, even operating at optimum conditions, are not able to yield an almost dry solid underflow. In the best cases, the solid concentration never reaches more than 60% by weight. Therefore, these processes have an economic drawback due to the solvent loss in the asphaltenic stream.

In the previously mentioned U.S. Pat. No. 3,159,571, as well as in U.S. Pat. No. 4,101,415, it is indicated that the solvent can be recovered in a conventional stripping column where any residual precipitant is flashed off and recycled into the system. Again, the stripping column will have an efficient operation removing the solvent only if the asphaltenes are in a low viscosity liquid phase. Otherwise, when heated with steam the asphalt will stick to the walls and pipes, plugging the stripper. This, of course, limits application of the process to asphaltenes of medium or relatively low softening points (<180° C.).

To overcome this problem with high softening point asphaltenes, U.S. Pat. No. 3,159,571, suggests admixing the asphaltenes with a suitable diluent in order to discharge the solids as dissolved matter. Clearly, however, the addition of any fluxant is detrimental to the yield of valuable liquid products from the deasphalting operations and it is detrimental to the process economics, since the fluxant, which is of higher value than the asphaltenes, is mixed with them and discharged.

Canadian Pat. No. 842,768 describes an improved process with respect to earlier patents, which uses a hydrocarbon/alcohol mixture as precipitant and in which the separation of the solid asphaltenes is performed in a system of two hydrocyclones. The suspension of solid asphaltene particles leaving the hydrocyclone is passed through a filter where the asphaltenes are retained and after removal of the liquid left in the filter cake, the asphaltenes have a powdery appearance. The filtrate is recycled back to the process as precipitant. Although in this patent it is shown that it is possible to filter the asphaltenes, it is not demonstrated that filtration could be economically attractive in a commercial size plant. Because of the very small size of asphaltene particles, filtration rates would be extremely low and the process would incur very high capital and operating costs. The filter cake would retain a significant amount of solvent that would have to be recovered in an additional stage to avoid expensive solvent losses. This solvent recovery stage is not disclosed in the Canadian patent.

U.S. Pat. No. 4,211,633 discloses a process to separate asphaltic materials from liquified coal or other liquified hydrocarbonaceous materials, using a natural gasoline fraction with a boiling range of 200° to 400° F. as a solvent extraction agent and then effecting a centrifugal separation of the asphaltic fraction at elevated temperatures and pressures. The temperature range is 100°-200° C. and pressure is 2-10 atmospheres. Although it is stated that the resulting separated asphaltic material will have far less heptane soluble material than that obtained by the above-mentioned procedures, this conclusion is based on the assumption that centrifugal equipment that can operate at high pressure and temperature is commercially available. It is well known that large size centrifuges, which can stand these levels of pressure and temperature, are not yet on the market although they are in the development stage.

The process includes only one separation stage using a centrifugal type reactor operating at high pressure and temperature. In this unique centrifuge, the asphaltic fraction is hypothetically withdrawn from the centrifuging zone substantially free of oil and resins and is discharged. However, it is known from present practice in centrifuge technology that currently it is not possible to obtain a practically dry solid from this equipment, and that it must contain at least 20 to 40% by weight of entrained solution. Thus, the solvent losses increase solvent make-up and oil and resins dissolved in the entrained solution decrease the overall yield of oil recovered—all factors which reduce process feasibility.

Also, it is well known in the art that as the extraction temperature increases, the deasphalted-oil yield is reduced. (D. L. Mitchell and J. G. Speight, "The Solubility of Asphaltenes in Hydrocarbon Solvent", *FUEL*, Vol. 5, 149-52 (April 1973)). Therefore, a larger fraction of asphaltenes would be precipitated if U.S. Pat. No. 4,211,633 were followed. These drawbacks limit the commercial application of the process and make its use on an industrial scale impractical.

U.S. Pat. No. 4,101,415, assigned to Phillips Petroleum Co., relates to a process that combines the traditional liquid-liquid extractor with a second stage liquid-solid separator. It is disclosed that the performance of a counter-current contactor can be improved by using a second separation stage to separate solid asphaltenes. Although the type of equipment used in the liquid-solid separation zone is not disclosed, it is clear that this separation is effected at high pressure (550 psig) and at relatively high temperature. Also, the solvent to oil ratio of 40:1 in this zone is extremely large; consequently, the use of any type of centrifugal separator is precluded due to the extremely severe operating conditions and the large throughput to the separators. Solvent recovery from the asphaltenes is said to be performed in a flash zone without specifying any type of equipment. However, under the operating conditions specified in this zone (5psig and 50° F.), it is clear that the process is preferentially applied to solvents like propane and butane as shown in the typical operation example. In any case, this process is more oriented toward the production of lube oil stock and blended asphalt. It is an improvement of the conventional liquid-liquid extraction processes that use the traditional liquid contactor, and is generally limited to a low or moderate yield of deasphalted oil.

Great Britain Pat. No. 1,340,022 discloses a process for the preparation of aqueous asphaltene suspensions. The suspensions produced include a colloidal clay, which serves as a stabilizer and a nonionic detergent. The suspension is stable for long periods of time and can be used to handle and transport the asphaltene slurry coming out from the hydrocyclone, from which the solvent can be removed by evaporation. The water suspension can be easily transported after the solvent has been removed at a temperature lower than 100° C. The main drawback of this method of handling solvent recovery from the solid asphaltenes is the cost increase due to detergent and stabilizer consumption, since they are discharged with the asphaltenes. Another disadvantage is that the addition of clay can be detrimental in the combustion of the asphaltene suspension, causing damage at the burner tips and producing fouling in the tubes of the boiler, reducing its thermal efficiency. In addition, if this suspension is filtered to recover the detergent-water solution, the filtration process is significantly hindered by the presence of fine clay particles.

Previous processes for separation of solid asphaltenes do not provide a reliable and economic technique to recover the solvent from the asphaltene fraction and have hindered scale-up to commercial application. Solid deasphalting technology has not been available for commercial exploitation in the absence of a practical and economical method to recover the solvent, minimizing entrainment of resins.

Among other disadvantages, high energy costs are incurred in the processes described in the prior art since very diluted asphaltene slurries must be first evaporated and then stripped to completely recover the precipitating solvent.

Also, in prior art evaporation procedures sticking of the asphaltenes to the heating surfaces creates insurmountable operating difficulties making commercial applications unfeasible. The hard asphaltic residue, which normally has a high softening point and contains high concentrations of metals, usually begins to decompose at temperatures well below its softening point, creating insurmountable problems in conventional deasphalting equipment, which operates with butane or pentane, and in which solvent recovery from asphaltenes is done in conventional evaporators.

SUMMARY OF THE INVENTION

The disadvantages of the prior art have now been overcome by the present invention, which employs centrifugal separators to separate the solid asphaltic material in combination with a dispersion drier to recover substantially all solvent without fouling by asphaltenes.

Accordingly, this invention provides a process for separating substantially dry asphaltenes of high softening point from heavy hydrocarbon material, comprising the following steps:

(a) admixing heavy hydrocarbon material containing asphaltenes with a solution of deasphalted oil and an aliphatic hydrocarbon precipitant with five or more carbon atoms in a first mixing zone to form a mixture and to precipitate the asphaltenes in form of fine solid particles;

(b) introducing the mixture from step (a) into a first separation zone and separating said mixture into (i) a first solution of deasphalted oil and precipitant, practically free of asphaltenes, and (ii) a slurry of solid asphaltene particles suspended in a second solution of precipitant and deasphalted oil;

(c) separating the first solution of step (b) to obtain said precipitant and the deasphalted oil almost free of asphaltenes and with a much lower metal content than in the original heavy hydrocarbon material;

(d) introducing the slurry of suspended asphaltenes withdrawn from the first separation zone in step (b) into a second mixing zone and washing the slurry with a volume of fresh precipitant to remove entrained deasphalted oil still remaining in the slurry;

(e) introducing the mixture from the second mixing zone of step (d) into a second separation zone that comprises a centrifugal decanter to effect a separation of a liquid phase comprising a solution of deasphalted oil in precipitant from a highly concentrated slurry of solid asphaltenes impregnated with a small fraction of entrained solvent;

(f) recycling the solution of deasphalted oil in precipitant from the second separation zone of step (e) to said first mixing zone to effect the precipitation of the asphaltenes in step (a);

(g) introducing the concentrated slurry of solid asphaltenes from the second separation zone of step (e), into a solvent removal system to recover the solvent from the slurry and to obtain a product comprising fine particles of high softening point asphaltenes substantially free of solvent and deasphalted oil; and (h) recycling the solvent recovered in the solvent removal system of step (g) to the second mixing zone of step (d).

Figure 1:
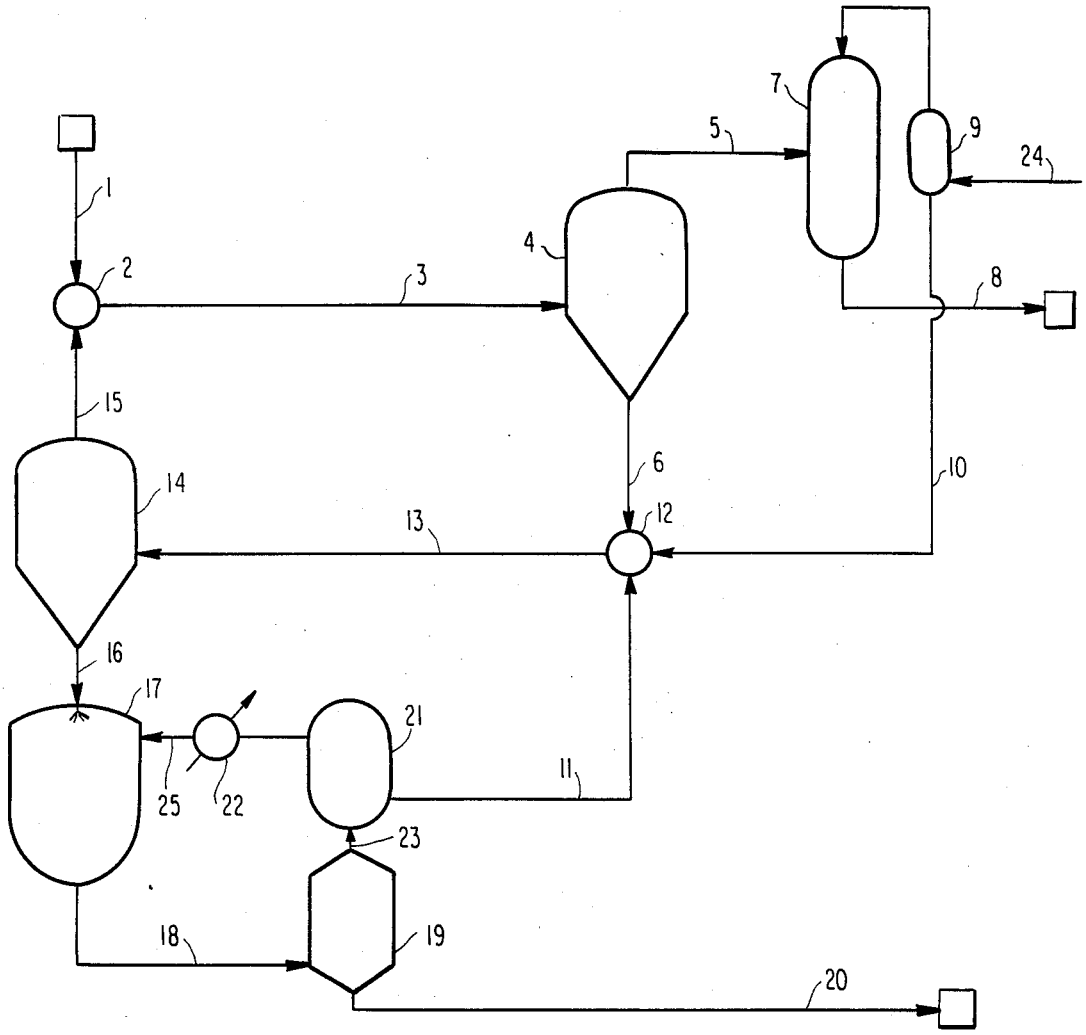
FIG. 1 is a schematic illustration of the process of this invention as used to separate the asphaltenes in a dry powdery form.

Lines for heat exchangers, pumps and control valves are not shown in the figures.

DESCRIPTION OF THE PREFERRED EMBODIMENTS

The combined use of a centrifugal decanter and a dispersion dryer system is a completely new invention that solves, for the first time, long-recognized problems in recovering solvent from heat labile solid asphaltenes, described as insurmountable in the prior art. The improvement of this novel arrangement of equipment over prior art systems using only hydrocyclones or centrifuges for solvent recovery permits surprisingly high recovery of expensive solvents. Typically, the asphaltene slurry obtained from the bottom of the centrifugal decanter is highly concentrated in asphaltenes, about 40% by weight or more, compared with not more than 15% by weight by prior art methods, in which it has been virtually impossible to recover economically the solvent from said slurry.

Another important feature of the present invention is that it allows thorough washing of the asphaltenes, and essentially complete elimination of resins from the precipitated solids. This resin removal operation is essential for producing nonsticky asphaltenes, which may be dried in the dispersion dryer without fouling the dryer walls. This very efficient washing operation is permitted only because of the concentrated asphaltene slurry produced by the centrifugal decanter, which eliminates the large solvent recirculation that has been required in prior art methods.

This has important economic significance in reducing evaporation and drying costs. The low concentration of solvent in the asphaltene slurry obtained with the centrifugal decanter makes it possible to recover the solvent in the dispersion dryer by means of direct heating at temperatures well below the asphaltene softening point, avoiding sticking and plugging during solvent evaporation.

Deasphalted oil yield is increased by an improved method for washing the solution entrained by the asphaltenes, and solvent recovery from those high softening point solids is increased by a process which can be economically scaled up to commercial application.

Summarizing some of the advantages gained using the present invention, it enables the selective extraction of a vary large fraction of oil and resins from petroleum residues using solvents, like hexane or naphthas, heavier than the solvents used in commercial processes today which have pentane as the heaviest solvent, and at the same time concentrates detrimental metals, such as vanadium and nickel, in the heat labile asphaltenes of high softening point.

The present process separates the asphaltenes in a solid form in industrially available centrifugal decanters at a temperature which is far below the softening point of these asphaltenes. This feature guarantees the operability of these centrifugal decanters, avoiding any sticking to their internal surfaces. The low moisture content of the asphaltene cake coming out from the centrifugal decanter allows a proven and economically efficient way to recover the solvent contained in the asphaltenes, solving a problem which until now had not yet been overcome.

Dispersion drying of the concentrated asphaltene cake has also been demonstrated for the first time, providing a straightforward and economical procedure for solvent recovery from those solids. A key feature in this drying stage is the use of direct-contact heat transfer at temperatures below the softening point of the asphaltenes. The unique combination of unit operations that has been demonstrated for the first time in the present invention eliminates any sticking of asphaltenes to the metal surfaces of the heat transfer equipment, and makes industrially feasible a process that until now had not been possible.

Furthermore, one of the main applications of the herein disclosed invention is in the deasphalting of hydrocarbon materials that have been submitted to a thermal conversion process, like visbreaking and hydrovisbreaking, in which the resins and asphaltenes have been transformed into very labile asphaltenes, easily decomposed by heating. Deep deasphalting of these thermally treated residues is selective and a high yield of deasphalted oil with a rather low content of metals (vanadium, nickel, iron, etc.) is obtained. This invention permits removal of the solvent under conditions which are far lower than the decomposition temperature of the asphaltenes, preventing fouling, and in addition the asphaltenes are obtained practically free of resins, facilitating their drying.

By this improved process for upgrading a heavy hydrocarbon material to produce a large fraction of oil almost free of asphaltenes, heavy hydrocarbon materials, such as heavy crude oils or petroleum residual fractions containing oil, resins and asphaltenes are mixed with a precipitant comprising a mixture of aliphatic hydrocarbons having 5–12 carbon atoms in the molecule. Upon mixing with the precipitant, asphaltenes present in the hydrocarbon material are precipitated in a solid form as fine particles, while oils and resins are removed by the asphaltene precipitant, which acts as a solvent for these components. The asphaltenes are separated in a first stage by means of a centrifugal separator, and are then washed with a given amount of fresh solvent to eliminate the entrained oil and resins. In a second centrifugal stage, a slurry of solid asphaltenes of high softening point practically free of resins is separated. This slurry is finally dried in a closed circuit dryer to obtain the asphaltenes in the form of a dry and powdery solid.

The precipitant agent is recovered in a conventional way from the mixture of oil and precipitating agent after separation in the first centrifugal stage. Alternatively, if desired, the solvent can be separated from the oil under supercritical conditions, as described in U.S. Pat. No. 4,239,616.

In one embodiment of the invention, the first stage separation of the asphaltic material can be effected in a hydrocyclone, or a disc centrifuge under operating conditions insuring an almost complete clarification of the oil-solvent solution. This step is performed at ambient temperature and at a pressure sufficient to pump the slurry through the equipment and to avoid solvent vaporization. In an alternate embodiment, the mixture is heated to 150° C. in order to agglomerate the fine asphaltene particles before the separation is accomplished.

In a preferred embodiment of the present invention, the combined use of a centrifugal decanter in the second separation stage and a dispersion dryer to recover the solvent from the solid asphaltenes increases the yield of deasphalted oil, while allowing for the high softening point asphaltenes. In this embodiment, the suspended solid asphaltenes leaving the first stage are washed with fresh solvent to remove completely the resins and oil still remaining in the solid and are fed to a second separation stage. In the second stage a centrifugal decanter operates at ambient conditions to separate a highly concentrated slurry of solid asphaltenes, with only a small fraction of retained solution having a very low concentration of oil and resins, therefore reducing the entrainment of resins and oil in the asphaltenes.

The concentrated asphaltene slurry is then dried in a direct contact dispersion dryer to recover substantially all of the solvent, obtaining essentially completely dry asphaltenes in a powdery form, practically free of resins. The dryer operates at a temperature which is at least 50° to 100° C. below the softening point of the asphaltenes, and quickly and efficiently removes the solvent from the solid, avoiding any possibility of the asphaltenes sticking to the dryer walls.

The drying system of the present invention provides direct contact heat transfer between a hot inert gas and the asphaltene particles, achieving a complete solvent recovery from the heat labile asphaltenes without operating problems such as the coke formation and tube wall fouling of conventional evaporators.

In an alternate embodiment of the invention, the slurry of solid asphaltenes leaving the second separation stage can be admixed with a volume of aqueous solution of a detergent at specific concentration and operating conditions, and the retained solvent removed from the resulting mixture by evaporation. After removing the solvent, a suspension of asphaltenes in water is obtained that can be easily pumped and filtered, or separated in a settling zone, therefore minimizing the detergent and water consumption. In this case, the asphaltenes are recovered from the filter of the settling zone, where the separation occurs in the absence of solvent and at almost ambient temperature, in the form of water-wetted solid particles that can be easily transported and handled to storage.

In this embodiment the use of a clay as a suspension stabilizer is eliminated. The required stability of the aqueous suspension is achieved by means of mechanical agitation and addition of specific compounds which do not interfere with the further separation process (filtration, sedimentation, etc.) and that retain the quality of the asphalt as a good solid fuel. Power consumption is relatively low, since good stability conditions are obtained with power consumptions lower than 2 HP/m$^3$ of solution volume employing standard mixing impellers.

The invention permits the recovery of a large fraction of oil and resins from heavy oil and residues; these deasphalted oils have a rather low metal content and they are substantially free of asphaltenes. The present process separates, easily and efficiently, the small fraction of high softening point and heat labile asphaltic materials from the main fraction of heavy crude, which consequently can be further economically upgraded.

An additional advantage is that the process of the present invention is especially suitable for removing asphaltenes from hydrocarbon residues that have been submitted to a thermal conversion process, e.g., visbreaking or hydrovisbreaking. In this case the process is highly selective regarding the metal content in the deasphalted oil, since the metals are preferentially concentrated in the polycondensed aromatic rings which form the hard solid asphaltenes that precipitate when a very high yield of deaphaltened, oil is obtained. These hydrogen deficient heat labile asphaltenes, which decompose easily into coke when heated to 180° C., can be easily handled in the process according to this invention allowing essentially complete solvent recovery.

The process steps of the present invention are illustrated in FIG. 1. A feedstock including a heavy hydrocarbon material is introduced into a mixing zone 2 through line 1.

The heavy hydrocarbon material can be any heavy crude oil, or an atmospheric or vacuum residue of any crude oil, or hydrocarbon residues that have been submitted to a thermal conversion process such as visbreaking or hydrovisbreaking.

A precipitant stream from a source 14 is introduced into mixing zone 2 to contact and admix with the feed to provide a mixture. The precipitant is a mixture of aliphatic hydrocarbons having 5–12 carbon atoms in the molecule, such as pentane, hexane, heptane or a light naphtha with a boiling range within 80° to 160° C. The mixing zone 2 can be any mixer from those conventional in the art, suitable for suspending precipitated particles in a liquid stream, and is typically a static inline mixer or an agitated tank where solid particles of asphaltenes are precipitated and suspended in the liquid stream. Sufficient solvent is introduced into mixing zone 2 to provide a feed to solvent volume ratio in the range of from about 1:2 to 1:12 and preferably in the range of about 1:2 to 1:6. Larger quantities of solvent may be used, if desired, but generally are unnecessary.

The mixture of solvent, solid asphaltene particles and oil dissolved in the solvent, is withdrawn from mixing zone 2 and introduced into a centrifugal separator 4, via line 3. This centrifugal separator can be a hydrocyclone or a disc centrifuge. Preferably a hydrocyclone of small diameter, e.g., about 10–30 mm, is used. Operating conditions are preferably controlled such that the asphaltene content (measured as heptane asphaltenes) in the overflow through line 5 of the centrifugal separator is less than about 2 to 0.5 percent by weight based on the weight of the deasphalted oil after removal of the solvent. Typically, asphaltenes are separated in a solid phase at near atmospheric pressure and a temperature under about 40° C.

When hydrocyclones are used in this first separation stage, preheating of the mixture is usually required to agglomerate the solid asphaltene particles. The exact temperature depends on the type of precipitant being used, but a preheating temperature in the range of 30°–150° C. is usually sufficient to obtain a fast agglomeration of the precipitated particles, e.g. on the order of 0.5 to 1 min., when using pentane is precipitant. Asphaltenes precipitated with hexane will require a higher temperature (e.g., in the range of 80° to 150° C.) than asphaltenes precipitated with pentane (e.g., in the range of 30° to 130° C.). This temperature level must be exactly determined and controlled to insure good clarification in the hydrocyclone. In any event, the heated agglomerated solution must be cooled before separation to ensure that separation is performed at a temperature not higher than about 45° C. to avoid plugging or clogging of the cyclone apex.

If a disc centrifuge is used in the first separation stage, the preheating stage is not required since this machine has a much higher capacity for clarification than the hydrocyclone. In this case the separation is conducted at a temperature of about 15°–25° C. At these temperatures the vapor pressure of the solvent is low enough to allow use of any commercially available gas-tight disc centrifuge which can withstand a pressure of up to 10 psig.

To increase the throughput, several centrifuges or hydrocyclones can be connected in parallel. In the case of hydrocyclones, so-called multicyclone systems can be used, which are units that contain a large number of small hydrocyclones in one case with one common inlet line and two discharge lines attached to the same case.

The mixture of oil and precipitant almost free of asphaltenes, i.e., typically with an asphaltene content of less than about 1% by weight based on deasphalted oil, is withdrawn from the first centrifugal separator 4 through line 5 and introduced into a solvent recovery zone 7, where the precipitant is essentially completely separated from the oil. This solvent recovery stage can be any system which operates above the critical temperature of the solvent and at a pressure level at least equal to the actual vapor pressure of the solvent at its highest temperature. Typically, a conventional system which comprises an evaporator and a stripper or a phase separator is used.

The recovered solvent leaving the solvent recovery zone 7 is introduced into solvent storage tank 9 to be recycled into the system via line 10. The oily phase essentially free of solvent and asphaltenes is withdrawn from the solvent recovery zone 7 via line 8 to storage.

The slurry formed by solid asphaltenes suspended in the oil-solvent solution leaves the first centrifugal separator 4 through line 6 and is introduced in in-line mixer 12 where it is washed with fresh solvent from storage tank 9, provided through line 10. The nature of this in-line mixer is not unduly restricted, and can be selected from those conventional in the art, such as an in-line mixer. Part of the solvent employed in said solvent wash is provided from source 21 through line 11. The fresh solvent is added to the asphaltene slurry in a 1:2 to 1:12, and preferably a 1:2 to 1:6, slurry to solvent volume ratio. This solvent wash eliminates most of the oils and resins retained by the solid asphaltenes, which typically after washing contains less than about 0.1% by weight oil and less than about 15% by weight resins.

The asphaltenes suspended in the solvent are introduced into centrifugal decanter 14, through lline 13. The scroll centrifugal decanter is not unduly restricted, and can be freely selected from those conventional in the art, such as for example, horizontal or vertical, co-current or countercurrent types. A commercially available scroll type centrifugal decanter is preferred, such as those manufactured by Bird Co., Esher Wyss Co., Alfa-Laval Co., Sharpless Co., Humbolt Co., or Krauss-Maffei Co. Centrifugal decanter 14 operates at a temperature range of 15° to 100° C., preferably 15° to 40° C. and at a pressure just sufficient to avoid solvent vaporization, which is well under the 10 psig maximum pressure usually specified for this gas-tight centrifugal decanter. In order to match the throughput with the first separation stage, several centrifugal decanters can be used in parallel, if desired.

The centrifugal decanter 14 discharges through line 15 a diluted solution of oil and resins dissolved in precipitant which is recycled to the first mixer 2, to precipitate the asphaltenes from the fresh hydrocarbon feedstock. From the bottom of the centrifugal decanter 14, a highly concentrated pulp of asphaltenes impregnated with only a small fraction of precipitant (e.g., on the order of 40% of less by weight) is withdrawn through line 16 by means of a screw conveyor and fed to the dryer system to recover the solvent. Any commercially available drying system capable of stripping solvent from the concentrated asphaltene slurry may be used. A currently preferred dryer system is a commercially available closed system dispersion dryer including a spray or flash dryer 17, a gas-solid separator 19, a scrubber condenser 21 and a gas heater 22. The drying system operates on a closed loop of inert gas which is used to strip the solvent from the solid asphaltenes. Such a closed system dispersion dryer is being commercialized by several manufacturers, e.g., Niro Co., Proctor and Schwartz, Inc. and Stork-Bowen Eng., and substantially reduces energy consumption, as has been pointed out by the manufacturers (Chemical Eng. Progress, April 1978, pp. 75, "Influence of Solvent Properties on Dryer Design".

The solid asphaltenes impregnated with the solvent enter the spray or flash dryer 17 where they are dispersed in very fine solid particles which dry quickly in presence of a hot inert gas, typically nitrogen, coming from the gas heater 22. The temperature in the dryer is at least 50° C. below the softening point of the asphaltenes, typically in the range of about 100° to 180° C., and preferably in the range of about 140° to 160° C. After the solvent has been evaporated and transferred to the gas stream, the solid asphaltenes become very hard solid particles almost completely free of oil and resins which are not sticky even at that temperature level. These solid asphaltene particles suspended in the mixture of vaporized solvent and the inert gas are withdrawn from dryer 17 and introduced through line 18 into gas-solid separator 19, where the dry solid asphaltenes are separated from the mixture of gas and vaporized solvent. The solid asphaltenes are discharged through line 20 in the form of a substantially completely dry and fine powder.

The vapor mixture leaves the gas-solid separator through line 23 to enter the direct contact scrubber condenser, where the solvent is removed from the inert gas by contacting the mixture with a counter-current stream of solvent sufficiently cold to condense the vaporized solvent in the mixture. The cold solvent employed as separation agent is recirculated and passed through an external cooler before entering the condenser. The condensed liquid solvent is evacuated from condenser 21 and pumped through the line 11 to the second mixer 12, to complete the solvent inventory to wash the asphaltenes.

The solvent works in a closed circuit in the whole process. Solvent recovery in the process is very high, typically over 99.9 percent, requiring only a small make-up of solvent which is introduced through line 24.

FIG., 2 illustrates an alternate embodiment of the present invention. This embodiment is identical except for the use of an alternate method for recovering the solvent from the asphaltene slurry leaving the centrifugal decanter 14. In this embodiment, asphaltenes impregnated with solvent are introduced via line 16 into evaporator 24 where they are admixed with an aqueous solution of a surfactant while solvent evaporation is taking place. Evaporation occurs at a temperature sufficiently high to evaporate completely the solvent but not so high as to evaporate the water. This temperature should be in the range of about 60°–100° C., and preferably in the range of about 75°–85° C., depending on the normal boiling point of the solvent used, which in any case, should be less than 100° C. since the system operates at atmospheric pressure. The evaporator unit may be freely selected from those conventional in the art. Typical evaporators useful in the present invention include, for example, a forced convection evaporator.

Inside the evaporator, after solvent removal a suspension of asphaltenes in water is formed while the system is continuously being agitated through the mixing impeller 25, maintaining mechanical power input sufficient to avoid solid decantation during evaporation. Generally this mechanical power input is at least equivalent to 2 HP/m$^3$ of suspension volume to the mixing impeller, or otherwise the suspension becomes unstable. The suspension comprises from about 5–25 wt % of asphaltenes and from about 0.001–0.1 wt % of a surfactant. The surfactant can be any industrial detergent, as for example, dodecylbenzenesulfonate or sodium naphthosulphonate or the like.

If desired, a basic compound may be added to the suspension as a pH modifier. The pH modifier is not restricted, but may be freely selected from those conventional in the art, such as sodium hydroxide, potassium hydroxide, magnesium hydroxide or sodium carbonate. The pH modifier is added in amounts sufficient to produce a stable asphaltene suspension in the mixture with solvent and water, generally resulting in a pH of from about 7 to about 9. Usually a concentration of 0.001 to 0.01 wt. % of the pH modifier compound in the suspension is enough to improve the suspension stability. Preferably, a concentration of about 0.008 wt % is used to reduce the mechanical power input required. Although it is not well understood why this happens, it is considered that those alkalies help to saponify the naphthenic acid chains existing in the asphaltene molecule (see Yen, T. F., "Structure of Petroleum Asphaltenes and its Significance", *Energy Sources* 1 (4), 447 (1974)), reinforcing considerably the action of the added surfactants.

The addition of a pH modifier helps to reduce the mechanical power required to obtain a stable water-asphaltene emulsion at the exit of the stirred evaporator vessel 24. For example, Table 1 below shows that as the concentration of the pH modifier in the suspension increases, the power input required by unit of volume to maintain a stable suspension decreases substantially. This important finding shows that a small amount of pH modifier added to the suspension significantly reduces the power consumption and the agitation level required to stabilize the asphaltene-water suspension.

The suspension of asphaltenes in water, free of solvent, is withdrawn from evaporator 24, through line 18 and introduced to a solid separator stage 19 to separate the asphaltenes from the water solution.

TABLE 1

| pH Modifier Concentration in the Suspension (weight %) | Power Input Required to Maintain a Stable Suspension (HP/m$^{3*}$) |
|---|---|
| 0 | 39.0 |
| 0.002 | 20.5 |
| 0.004 | 11.6 |
| 0.006 | 4.9 |

TABLE 1-continued

| pH Modifier Concentration in the Suspension (weight %) | Power Input Required to Maintain a Stable Suspension (HP/m$^3$*) |
|---|---|
| 0.008 | 2.9 |
| 0.010 | 1.5 |

*Mechanical power input per unit of suspension volume.

The solid separation stage 19 can be any solid-liquid separation equipment, and is typically a conventional continuous rotary filter or a settling tank. The aqueous suspension of solid asphaltene particles wetted with the detergent and pH modified solution can be easily filtered, since the asphaltenes are sufficiently completely free of solvent to behave as hard solid particles which do not stick to each other. This creates a suitable porosity in the cake that allows a high filtration rate. Also, the presence of a surfactant on the wetted surface of the asphaltene particles helps to keep these asphaltene particles separated. The asphaltenes are retained on the filter, and, after removal of the cake the asphaltenes are discharged through line 20 as water-wetted particles. After water has been evaporated by natural convection in open air, the asphaltenes have a dry and powdery appearance. The operation in solid separation zone 19 is effected at a temperature of about 15° to 80° C., preferably in the range of 20° to 60° C.

If a settling tank is used instead of a filter, the settling velocity of the solid asphaltene particles is increased by the size of these partially agglomerated asphaltenes, and therefore only a relatively small settling area is required. However, in this case, the asphaltenes discharged through line 20 will have a higher content of entrained water than the asphaltenes obtained from the filter cake.

The aqueous solution leaving the solid separation zone 19, via line 26, is passed through heater 22 to heat the solution to the evaporator temperature before it is returned to evaporator 24. This recycled aqueous solution contains most of the surfactant and pH modifier, since the amount of these compounds entrained by the asphaltenes is very small. Actually, the amount of these compounds discharged with the solid asphaltenes is proportional to the fraction of solution entrained by the asphaltenes, typically less than about 30%, and in any case is not larger than 40%, of the weight of the dry asphaltenes. The entrained solution is within about 1% to 5% of the water inventory in the closed system, and current 29 adds to the system enough water to maintain the water inventory constant in this solvent recovery system.

Figure 2:
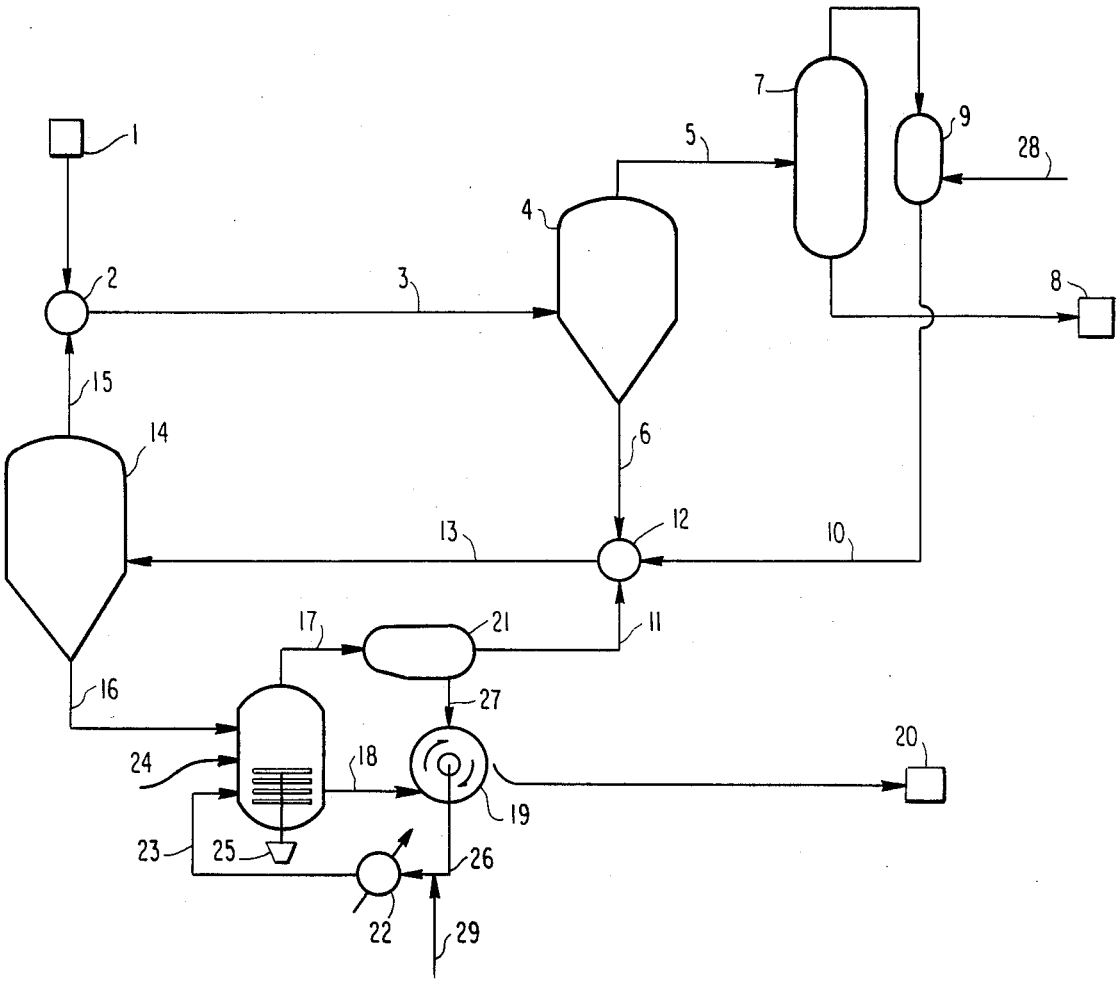
FIG. 2 is a schematic illustration of the process of the invention as used to recover solvent from the asphaltenes through evaporation from an aqueous suspension.

The solvent vapors are evacuated from evaporator 24 through line 17 and introduced in condenser 21 to be condensed and separated from the entrained water by means of a conventional liquid/liquid separator, not shown in FIG. 2. The condenser consists of shell and tubes and may be freely selected from those conventional in the art. Typically, a tubular condenser is used. In the condenser, any conventional liquid-liquid separator can be used, such as a knock-down drum. This entrained water which leaves condenser 21 at lower temperature is returned by line 27 to the solid separation zone 19, particularly when this is a rotatory filter, to wash the asphaltene cake, thereby helping to recover most of the detergent and pH modifier absorbed in the cake. The liquid solvent is withdrawn from condenser 21 and recycled back, via line 11 to the second mixing zone 12, thus completing the solvent closed circuit in the system.

Having thus described in broader terms embodiments of the present invention, the following more detailed description is provided with reference to specific examples. However, the following examples are not to be construed as limiting the scope of the invention.

COMPARATIVE EXAMPLE 1

This Comparative Example illustrates the limitations of a conventional system of hydrocyclones in series when used to obain a highly concentrated pulp of asphaltenes and a high yield of deasphalted oil. This Comparative Example is described with reference to FIG. 1.

The feed used in this example is an atmospheric residue (650+° F.) of Jobo crude oil with the properties given in Table 2.

TABLE 2

PRODUCT QUALITY FOR EXAMPLE 2
PROPERTIES OF FEED AND PRODUCTS

| STREAM | FEED RESIDUE 650° F. | DAO | ASPHALTENES |
|---|---|---|---|
| LINE IN FIG. 1 | 1 | 8 | 20 |
| SPECIFIC GRAVITY 60/50 | 1.0239 | 0.9993 | 1.1 |
| API° GRAVITY | 6.7 | 10.1 | −2.9 |
| SULFUR wt % | 3.6 | 3.0 | 7.8 |
| CONRADSON CARBON wt % | 16.1 | 11.2 | 47.5 |
| HEPTANE ASPHALTENES wt % | 15.2 | 1.0 | — |
| NITROGEN wt % | 0.81 | 0.52 | 2.67 |
| VANADIUM ppm | 463 | 210 | 2100 |
| NICKEL ppm | 108 | 58 | 382 |
| SOFTENING POINT °C. | — | — | 220 |
| DROPPING POINT °C. | — | — | 232 |
| VISCOSITY | | | |
| cst AT 140° F. | 39130 | 3390 | — |
| cst AT 210° F. | 1169 | 200 | — |

100 kg/hr of this feed with 12 wt % of hexane insoluble asphaltenes is admixed in mixer 2, with 647 kg/hr of a mixture of 0.2 wt. % of suspended asphaltenes, 0.93 wt % of deasphalted oil (DAO) and 98.87 wt % of hexane leaving the second hydroclone 14. through line 15. The mixer is a static in-line mixer that operates at a temperature below 80° C. The resultant mixture is heated to 150° C. to floculate the asphaltenes and cooled down to 45° C. to be fed to the first hydrocyclone 4 at a rate of 747 kg/hr, with a composition of 1.73 wt % of asphaltenes, 12.6 wt % of DAO and 85.67 wt % of hexane. From the cyclone overflow, 623 kg/hr of a mixture with only 0.065 wt % of suspended asphaltenes is collected through line 5. After solvent removal in evaporator 7, 540.6 kg/hr of solvent is recovered in condenser 9, and 82.4 kg/hr of a solution of 82 kg/hr of deasphalted oil and 0.4 kg/hr of asphaltenes is evacuated through line 8. The evaporator is a forced convection evaporator that operates at atmospheric pressure and temperature under 120° C. The condenser is a shell and tube type. From the bottom of the first hydrocyclone stage 4, 124 kg/hr of a slurry with 80.3 wt % of hexane, 9.7 wt % of DAO and 10 wt % of suspended asphaltenes is introduced through line 6 into mixer 12 to be washed with 540.6 kg/hr of hexane from line 10 and 59.4 kg/hr of hexane from line 11. Mixer 12 is a static in-line mixer that operates at a temperature below 80° C. The total mixture is fed through line 13 at a rate of 724 kg/hr to a second hydrocyclone 14. The overflow leaving the top of hydrocyclone 14 recycles back to mixer 2 a total of 647 kg/hr through line 15. The 77 kg/hr of slurry leaving the bottom of hydrocyclone 14 through line 16 includes 6 kg/hr of DAO, 11.6 kg/hr of asphaltenes and 59.4 kg/hr of solvent. 59.4 kg/hr of solvent is removed and recycled back to mixer 12. 17.6 kg/hr of asphaltenes with a 34 wt % content of DAO is discharged through line 20.

Each hydrocyclone 4 and 14 is a battery of 10 mm diameter cyclones that operate at a flowrate of 4.5 l/min. and a pressure drop of 5.4 kg/cm$^2$. The operating temperature in hydrocyclone 14 is 25° C.

This comparative example clearly shows that the yield of deasphalted oil is limited to 82.4%. when two hydrocyclones are used in series. This low yield is mainly due to the fact that the amount of solvent reteined in the underflow leaving the second hydrocyclone 14 is high and the DAO dissolved in said solvent is entrained with the solid asphaltenes, decreasing the overall yield of deasphalted oil.

Table 3 below gives a complete mass balance of different streams in this example, with reference to FIG. 1.

EXAMPLE 1

This Example shows one embodiment of the present invention, with reference to FIG. 1. 100 kg/hr of the same atmospheric residue used in Comparative Example 1 is mixed, in mixer 2, with 442 kg/hr of a mixture from line 15 coming from the top of centrifugal decanter 14, to integrate stream 3. The mixer and operating conditions are the same as used in comparative Example 1. The total mixture is heated to 150° C. to floculate the asphaltenes and then cooled to 45° C. to be fed to the hydrocyclone 4. The hydrocyclones are 10 mm internal diameter cyclones that operate at a flowrate of 5.4 lt./min. and a pressure drop of 5.4 kg/cm$^2$ at 25° C. From the top of hydrocyclone 4, through line 5 is separated 438 kg/hr of a clarified product that contains 0.10 wt % of asphaltenes, 19.6 wt % DAO and 80.3 wt % of hexane to be fed to the solvent removal zone 7 to recover 351.7 kg/hr of pure hexane in condenser 9 and 86.5 kg/hr of a solution containing 99.42 wt % of deasphalted oil free of hexane, and only 0.58 wt % of asphaltenes. Solvent removal is done in a forced convection evaporator at 110° C. and atmospheric pressure.

Through line 6, 104 kg/hr of a slurry that contains 12 wt % of asphaltenes, 17.3 wt % of DAO and 70.7 wt % of hexane leaves the bottom of hydrocyclone 4, to be mixed with 351.5 kg/hr of fresh solvent from line 10 and 11 kg/hr of fresh solvent from line 11, in mixer 12. Mixer 12 is a static on-line mixer. The total 466.5 kg/hr admixture leaving mixer 12 and containing 2.68% of solid asphaltenes is introduced in a centrifugal decanter 14 to recover through line 15, 442 kg/hr of a deasphalted oil solution that contains 3.6 wt % of DAO and 0.23 wt % of solid asphaltenes, and 96.17 wt % hexane is recycled back to the first mixing zone 2. The centrifugal decanter 14 is a horizontal countercurrent scroll type decanter 0.23 m in diameter that operates at 25° C. and a differential speed between the scroll and the rotor of 17 rpm at a rotor speed of 2324 rpm.

From the bottom of centrifugal decanter 14, 24.5 kg/hr of a concentrated slurry of solid asphaltenes leaves the decanter through line 16. This slurry containing 47 wt % of asphaltenes, 8.2 wt % of DAO and 44.8 wt % of hexane is fed to a spray dryer 17. A spray dryer is used where the feed is atomized using a rotating wheel or nozzles, and the spray of droplets immediately contacts a flow of hot gases. The resulting rapid evaporation maintains the temperature of the sprayed droplets low, around 160° C. at atmospheric pressure. The spray dryer 17 operates under a nitrogen atmosphere at 160° C. in the drying chamber. A bag house collector 19 is used to collect and discharge the dried solid asphaltenes through line 20 to obtain 13.5 kg/hr of solvent-free asphaltenes with only 14.8 wt % of DAO. The properties of the final products obtained in this example are also given in Table 3 below.

Example 1 clearly shows the advantage of the combined use of the scroll decanter and the sprayer dryer to obtain a higher yield of deasphalted oil of 86.5 wt % over the feedstock against a yield 82.4 wt % as shown in Comparative Example 1. The higher yield is obtained mainly by reducing the entrainment of DAO in the solid asphaltenes to only 14.8 % as compared to the 34% resulting in Example 1.

Table 3 summarizes the mass balance of this example.

COMPARATIVE EXAMPLE 2

This comparative example shows the limitation of deasphalted oil yield when only one separation zone is used. This Comparative Example is described with reference to FIG. 1. In this comparative example, 100 kg/hr of the same residue used in Comparative Example 1 and Example 1 is mixed with 400 kg/hr of fresh hexane in mixer 2, to obtain 500 kg/hr of a mixture that contains 17.6 wt % of DAO and 2.4 wt. % of solid asphaltenes suspended in the oil-solvent solution. An in-line static mixer is used. This mixture is fed directly to a scroll type centrifugal decanter 4 0.23 m in diameter that operates at the same conditions indicated in Example 1. From the top 5 of the centrifugal decanter, 474 kg/hr is evacuated through line 5 containing 17.2 wt % of DAO, 0.21 wt % of asphaltenes and 82.59 wt % of hexane. After solvent removal from this stream in the evaporation zone 7, 82.5 kg/hr of a solution of 99.4 wt % deasphalted oil free of solvent and 0.61 wt % of asphaltenes is discharged through line 8. A force convection evaporator is used.

A concentrated slurry of solid asphaltenes wetted with solvent is discharged from the bottom of the centrifugal decanter 4 at a rate of 26 kg/hr. After solvent recovery from this slurry, 17.5 kg/hr remains of which 63 wt % is solid asphaltenes and 37 wt % is DAO. Solvent removal is done in a spray dryer operating at 160° C. in the drying chamber under a nitrogen atmosphere.

These experimental results show that the yield of deasphalted oil in a one-stage separation process is limited to 82.5 wt % of the atmospheric residue introduced into the deasphalting section and that a centrifugal decanter, operated in only one state, yields a higher concentration of asphaltenes in the deasphalted oil due to its lower clarification capacity.

Table 3 gives detailed information on the streams in this Comparative Example.

EXAMPLE 2

This example shows an embodiment of the present invention using a centrifuge in the first separation zone combined with a centrifugal decanter in the second separation zone. This example is described with reference to FIG. 1. 100 kg/hr of the same residual oil of Comparative Example 2 is admixed with 418.5 kg/hr of a solution from source 14 that contains 96.63 wt % of hexane, 3.13 wt % of DAO and 0.24 wt % of solid asphaltenes, and mixed in mixer 2. A static on-line mixer is used. The resultant mixture, that makes a total of 518.5 kg/hr and contains 77.99 wt % of hexane, 19.50 wt % of DAO and 2.51 wt % of solid asphaltenes, is fed through line 3 to disc centrifuge 4. Disc centrifuge 4 is a semi-commercial-size centrifuge 0.317 m in diameter having a solid bowl capacity of 4.4 l, and operates at 20° C. and 7000 rpm. This centrifuge has an intermittent solid discharge system with a discharge frequency of 2 discharges per minute and a partial discharge of 2.4 l each time. The centrifuge operates at a capacity of 2500 l/hr. Disc centrifuge 4 separates through line 5 a stream of 433.2 kg/hr of a clear liquid solution, that contains only 0.05 wt % of asphaltenes, 19.99 wt % of DAO of 79.96 wt % of hexane.

The clear liquid solution evacuated through line 5 is fed to solvent recovery zone 7 to recover 346.4 kg/hr of solvent in condenser 9 by means of a forced convection evaporator. Through line 8 is discharged 86.8 kg/hr of a solution of 99.77 wt % of deasphalted oil and 0.23 wt % of hexane insoluble asphaltenic material.

From the bottom of the disc centrifuge 4 through line 6 is evacuated 85.3 kg/hr of a solid suspension that contains 15 wt % of solid asphaltenes, 17 wt % of DAO and 68 wt % of hexane.

The solid asphaltene suspension leaving disc centrifuge 4 through line 6 is admixed with 346.4 kg/hr of fresh hexane from source 10 and 14.9 kg/hr of fresh hexane from source 11 in mixer 12. A static in-line mixer is used. The resultant 446.6 kg/hr of said mixture that contains 93.90 wt % of hexane, 3.24 wt % of DAO and 2.86 wt % of solid asphaltenes is fed to scroll type centrifugal decanter 14 to separate a clear liquid solution that is recycled, via line 15, back to mixer 2. Centrifugal decanter 14 is exactly as described in Example 1 and operates at 20° C. with the same operating conditions there indicated.

The slurry leaving the bottom of scroll decanter 14 through line 16 amounts to 28.1 kg/hr with a solid asphaltene concentration of 42.0 wt %, a hexane content of 53.0 wt % and a DAO content of 5.0%. This concentrated slurry is fed to the solvent removal zone 17 to recover 14.9 kg/hr of hexane that is recycled to mixer 12 through line 11 and 13.2 kg/hr of a mixture of 11.8 kg/hr of solvent-free asphaltenes and 1.4 kg/hr of DAO that are discharged through line 20. Solvent removal is performed in a spray dryer at 160° C. in the drying chamber under a nitrogen atmosphere. Those dried asphaltenes contain only 10.6 wt % of DAO.

This example illustrates a high yield of 86.8 wt % of deasphalted oil over the feedstock, as shown in Table 3.

TABLE 3

| | COMPARATIVE EXAMPLE 1 | | | | EXAMPLE 1 | | | | COMPARATIVE EXAMPLE 2 | | | | EXAMPLE 2 | | | |
|---|---|---|---|---|---|---|---|---|---|---|---|---|---|---|---|---|
| STREAM* | ASF kg/hr | DAO kg/hr | HEX kg/hr | TOTAL kg/hr | ASF kg/hr | DAO kg/hr | HEX kg/hr | TOTAL kg/hr | ASF kg/hr | DAO kg/hr | HEX kg/hr | TOTAL kg/hr | ASF kg/hr | DAO kg/hr | HEX kg/hr | TOTAL kg/hr |
| 1 | 12 | 88 | — | 100 | 12 | 88 | — | 100 | 12 | 88 | — | 100 | 12 | 88 | — | 100 |
| 3 | 12.9 | 94 | 640.1 | 747 | 13 | 104 | 425 | 542 | 12 | 88 | 400 | 500 | 13 | 101.1 | 404.4 | 518.5 |
| 5 | 0.4 | 82 | 540.6 | 623 | 0.5 | 86 | 351.5 | 438 | 1 | 81.5 | 391.5 | 474 | 0.2 | 86.6 | 346.4 | 433.2 |
| 6 | 12.5 | 12 | 99.5 | 124 | 12.5 | 18 | 73.5 | 104 | 11 | 6.5 | 8.5 | 26 | 12.8 | 14.5 | 58.0 | 85.3 |
| 8 | 0.4 | 82 | — | 82.4 | 0.5 | 86 | — | 86.5 | 1 | 81.5 | — | 82.5 | 0.2 | 86.6 | — | 86.8 |
| 10 | — | — | 540.6 | 540.6 | — | — | 351.5 | 351.5 | — | — | 391.5 | 391.5 | — | — | 396.4 | 346.4 |
| 11 | — | — | 59.4 | 59.4 | — | — | 11 | 11 | — | — | — | — | — | — | 14.9 | 14.9 |
| 13 | 12.5 | 12 | 699.5 | 724 | 12.5 | 18 | 436 | 466.5 | — | — | — | — | 12.8 | 14.5 | 419.6 | 446.6 |
| 15 | 0.9 | 6 | 640.1 | 647 | 1 | 16 | 425 | 442 | — | — | 400 | 400 | 13.1 | 1.0 | 404.4 | 418.5 |
| 16 | 11.6 | 6 | 59.4 | 77 | 11.5 | 2 | 11 | 24.5 | — | — | — | — | 11.8 | 1.4 | 14.9 | 28.1 |
| 20 | 11.6 | 6 | — | 17.6 | 11.5 | 2 | — | 13.5 | 11 | 6.5 | — | 17.5 | 11.8 | 1.4 | — | 13.2 |
| % YIELD DAO | 82.4 | | | | 86.5 | | | | 82.5 | | | | 86.8 | | | |

*with reference to FIG. 1.

EXAMPLE 3

This example further illustrates an embodiment of the present invention by describing operating conditions in the dispersion drying zone to remove solvent from the asphaltene slurry. The example is described with reference to FIG. 1.

A concentrated slurry of asphaltenes suspended in hexane prepared by the same method as Example 2 is obtained from the second separation zone 14 through line 16 that contains 42 wt % of solid asphaltenes, 5 wt % of DAO and 53 wt % of hexane. This concentrated slurry is pumped with a screw conveyor pump at a rate of 100 kg/hr to spray dryer 17. A spray dryer with a drying chamber 4 meters high and 1.2 meters in diameter is used. The slurry is fed through an atomizer, which consists of a "Proctor Paste Nozzle" for handling heavy pastes that allows atomization by means of a high shear within the nozzle itself. After atomization, the spray of droplets immediately contacts a flow of hot nitrogen at 160° C. and atmospheric pressure. The spray dryer uses a conventional type of dispersion system to disperse the slurry into the drying chamber as fine particles of solid asphaltenes and hexane that flashes off. The asphaltene particles are stripped with 150 kg/hr of hot nitrogen that is introduced to the dryer 17 through line 25, to completely vaporize the hexane still remaining within the solid. The inlet temperature of the nitrogen stream 25 into the dryer is 163° C. The mixture of nitrogen and vaporized hexane with the suspended solids leaves the spray dryer 17 through line 18 at 93° C. to enter into bag house separator 19 at a rate of 250 kg/hr. The dried solid asphaltene particles separated in solid separator 19 are discharged from line 20 at a rate of 47 kg/hr, consisting of 42 kg of hard asphaltenes that contain 10.6 wt % of DAO.

The hot gases leave bag house 19 to enter direct contact condenser 21 where the hextane vapor is condensed by means of 50 kg/hr of a circulating stream of cold hexane at 15° C., not shown in FIG. 1. The bag house has a retention chamber provided with bag collectors to retain fine particles (less than 20 microns). The bags discharge the solid fine particles through a cone shaped hopper system. The direct contract condenser is an empty tube that provides direct interchange of heat between the cool liquid hexane that is recirculated into the condenser and the hexane vapours coming from the bag collectors. Condensation occurs due to an increase in the liquid hexane temperature. A stream of 103 kg/hr of condensed hexane is evacuated from condenser 21, through line 11. 50 kg/hr of the condensed solvent is cooled and recycled back to the condenser 21; the remaining 53 kg/hr of solvent is sent to storage. Nitrogen gases, with only 5 wt % of hexane, leave the condenser 21 and are heated in the heat exchanger 22 to be recycled into the dryer 17 through line 25. The spray dryer 17 is a semi-commercial unit with a drying chamber 1.2 m in diameter and 4 m high. The operation of the spray dryer was completely free of any problem related to plugging or sticking of asphaltenes against the wall surfaces or discharge lines.

EXAMPLE 4

The example illustrates an alternative embodiment of the present invention using an aqueous suspension to remove the solvent from the asphaltenes leaving the second separation zone. This example is described with reference to FIG. 2.

An asphaltene slurry produced by the process of Example 2 in the second separation zone 14 that contains 30 wt % of solid asphaltenes and 70 wt % of hexane is fed at a rate of 100 kg/hr through line 16 to stirred evaporator 24. The stirred evaporator is a gas-tight vessel, that is continuously agitated by means of an impeller and heated with heating oil at a temperature of about 200° C. A hot water solution is introduced into evaporator 24 via line 23 at a temperature of 85° C. and at a rate of 2000 kg/hr. This solution contains 0.1 wt % dodecylbenzenesulfonate (DBS) and 0.005 wt % of sodium carbonate. Inside evaporator 24, a suspension of asphaltenes in water is formed and the hexane is easily evaporated at a temperature of 80° C. The asphaltene suspension is agitated with a turbine impeller 0.328 m. in diameter rotating at a speed of 750 rpm with a power consumption of 2.5 HP/m$^3$ to drive the stirrer 25.

The aqueous suspension that leaves the stirred evaporator 24 through line 18 contains 1.48 wt % of solid asphaltenes and 0.10 wt % of DBS and sodium carbonate, water being the balance. This suspension is fed to rotary filter 19 at a rate of 2025 kg/hr to separate 50.02 kg/hr of a cake of wet asphaltenes; this stream includes 30 kg/hr of dry asphaltenes, 20 kg/hr of water and 0.02 kg/hr of DBS. The rotary filter consists of a rotating drum filter of 0.2 meters in diameter and a cake thickness of 0.02 meters. The filter operates continuously and the coke is removed with a doctor knife. This wet cake is discharged through line 20. The filter operates at 50° C.

The clear water solution, free of asphaltenes, recovered in filter 19 through line 26 is heated to 85° C. in the heat exhanger 22 and is recycled back to the evaporator 24 via line 23.

The vapor leaving evaporator 24 at a rate 73 kg/hr contains 4.1 wt % entrained water, and is fed through line 17 to condenser 21 where 70 kg/hr of condensed hexane is discharged through line 11, and 3 kg/hr of pure water separated in a knock-down separator is sent to the filter 19, via line 27. The knock-down separator is a horizontal drum 0.3 m in diameter and 1 m in length with a water collector boot in the bottom. A make-up water solution, not shown in FIG. 2, of 20.02 kg/hr is added to line 26 to account for the water lost in the filtered asphaltenes.

While the invention has been described in detail and with reference to specific embodiments thereof, it will be apparent to one skilled in the art that various changes and modifications can be made therein without departing from the spirit and scope of the thereof.

We claim:

1. A process for separating substantially dry asphaltenes of high softening point, being accomplished without the use of an added fluxing agent, from heavy hydrocarbon material, comprising the following steps:

(a) a admixing heavy hydrocarbon material containing asphaltenes with a solution of deasphalted oil and an aliphatic hydrocarbon precipitant with five or more carbon atoms in a first mixing zone to form a mixture and to precipitate the asphaltenes in form of fine solid particles;

(b) introducing the mixture from step (a) into a first separation zone and separating said mixture into (i) a first solution of deasphalted oil and precipitant, practically free of asphaltenes, and (ii) a slurry of solid asphaltene particles suspended in a second solution of precipitant and deasphalted oil;

(c) separating the first solution of step (b) to obtain said precipitant and the deasphalted oil almost free of asphaltenes and with a much lower metal content than in the original heavy hydrocarbon material;

(d) introducing the slurry of suspended asphaltenes withdrawn from the first separation zone in step (b) into a second mixing zone and washing the slurry with a volume of fresh precipitant to remove entrained deasphalted oil still remaining in the slurry;

(e) introducing the mixture from the second mixing zone of step (d) into a centrifugal decanter to effect a separation of a liquid phase comprising a solution of deasphalted oil in precipitant from a highly concentrated slurry of solid asphaltenes impregnated with a small fraction of entrained solvent;

(f) recycling the solution of deasphalted oil in precipitant from the centrifugal decanter of step (e) to said first mixing zone to effect the precipitation of the asphaltenes in step (a);

(g) introducing the concentrated slurry of solid asphaltenes from the centrifugal decanter of step (e), into a closed system dispersion dryer to recover the solvent from the slurry and to obtain a product comprising fine particles of high softening point asphaltenes substantially free of solvent and deasphalted oil; and (h) recycling the solvent recovered in the closed system dispersion dryer of step (g) to the second mixing zone of step (d).

2. The process according to claim 1, wherein said heavy hydrocarbon material is selected from the group consisting of atmospheric residue from crude oil, vacuum residue from crude oil, residue from liquefied coal, tar sands, or atmospheric or vacuum residues of crude oils that have been previously processed in a thermal conversion process.

3. The process according to claim 1, wherein said precipitant employed has at least one aliphatic hydrocarbon having 5 to 12 carbon atoms in the molecule.

4. The process according to claim 3, wherein said precipitant is a naphtha with a boiling point between about 50° and 150° C.

5. The process according to claim 1, wherein the mixers in the first and second mixing stages are a static on-line mixer or a mixing tank, and the ratio of precipitant to feedstock of heavy hydrocarbon material is about 2:1 to 12:1 by volume.

6. The process according to claim 5, wherein the ratio of precipitant to feedstock of heavy hydrocarbon material is about 4:1 to 6:1 by volume.

7. The process according to claim 1, wherein said first separation zone comprises a centrifugal separator, a disc centrifuge or a battery of hydrocyclones with diameters of about 10 to 50 millimeters.

8. The process according to claim 1, wherein said first separation zone operates at a temperature of about 15° to 60° C. and a pressure only high enough to maintain the solvent in liquid phase, and to provide the pressure drop required by the separation means.

9. The process according to claim 1, wherein the mixture of precipitant solution and heavy hydrocarbon material is first heated in the first mixing zone to about 100° to 160° C. for less than about 0.5 minutes to agglomerate the asphaltenes and is then cooled to about 40° C. before entering the first separation zone.

10. The process according to claim 1, wherein the centrifugal decanter operates at a temperature of about 15° to 60° C. and a pressure less than about 10 psig, to separate a concentrated slurry of solid asphaltenes with a solid concentration of about 20% to about 80% by weight, that can be handled and transported by conventional screw conveyers.

11. The process of claim 10, wherein said centrifugal decanter operates to separate said concentrated slurry with a solid concentration of about 40% to about 60% by weight.

12. The process according to claim 1, wherein said closed system dispersion dryer operates in a closed loop of inert gas with a temperature in the drying chamber at least 50° C. below the softening point of the asphaltenes being dried.

13. The process according to claim 11 wherein said concentrated slurry is introduced in said closed system dispersion dryer to remove the precipitant so as to obtain dry solid asphaltenes of high softening point, free of solvent and resins with a powdery appearance without said dry solid asphaltenes sticking to or plugging the heat transfer surfaces.

* * * * *

UNITED STATES PATENT AND TRADEMARK OFFICE

CERTIFICATE OF CORRECTION

PATENT NO. : 4,572,781

DATED : February 25, 1986

INVENTOR(S) : Julio Krasuk, Rodolfo B. Solari, Luis G. Aquino, Jose V. Rodriguez and Alejandro Granados It is certified that error appears in the above-identified patent and that said Letters Patent is hereby corrected as shown below:

Abstract, line 9, following "(b)" and prior to "in" insert --separating--.

Signed and Sealed this

*Twenty-third* Day of *September 1986*

[SEAL]

*Attest:*

DONALD J. QUIGG

*Attesting Officer*

*Commissioner of Patents and Trademarks*